US009080284B2

(12) United States Patent
Areyur et al.

(10) Patent No.: US 9,080,284 B2
(45) Date of Patent: Jul. 14, 2015

(54) IRONING BOARD ASSEMBLY WITH CONFIGURABLE IRONING SURFACE

(75) Inventors: Mahesh Gurumalliah Areyur, Eindhoven (NL); Quee Kiang Lee, Eindhoven (NL); Seetharam Chigurupati, Eindhoven (NL); Kok Wah Ma, Eindhoven (NL); Wee Ann Chong, Eindhoven (NL); Valiyambath Krishnan Mohankuma, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 13/810,359

(22) PCT Filed: Jul. 18, 2011

(86) PCT No.: PCT/IB2011/053195

§ 371 (c)(1),
(2), (4) Date: Jan. 15, 2013

(87) PCT Pub. No.: WO2012/014121

PCT Pub. Date: Feb. 2, 2012

(65) Prior Publication Data

US 2013/0111788 A1 May 9, 2013

(30) Foreign Application Priority Data

Jul. 26, 2010 (EP) ..... 10170771
Nov. 15, 2010 (EP) ..... 10191127

(51) Int. Cl.
*D06F 81/10* (2006.01)
*D06F 81/00* (2006.01)

(52) U.S. Cl.
CPC ..... *D06F 81/10* (2013.01)

(58) Field of Classification Search
CPC ..... D06F 81/00; D06F 81/10; D06F 85/00
USPC ..... 38/103–140; 108/77–79
See application file for complete search history.

(56) References Cited

U.S. PATENT DOCUMENTS

| | | | | | |
|---|---|---|---|---|---|
| 476,332 | A | * | 6/1892 | Tubbs | 108/94 |
| 864,617 | A | * | 8/1907 | Culbertson | 108/63 |
| 2,729,005 | A | * | 1/1956 | Foster | 38/139 |
| 2,939,232 | A | * | 6/1960 | Munson | 38/139 |
| 2,999,325 | A | * | 9/1961 | Munson et al. | 38/140 |
| 3,045,373 | A | * | 7/1962 | Olswang | 38/137 |
| 3,143,086 | A | * | 8/1964 | Hilldale, Jr. et al. | 108/81 |
| 3,188,985 | A | * | 6/1965 | Lucas | 108/77 |
| 3,430,587 | A | * | 3/1969 | Bender et al. | 108/78 |
| 4,910,896 | A | * | 3/1990 | Ruschitzka | 38/106 |
| 5,016,367 | A | * | 5/1991 | Breen et al. | 38/135 |
| 5,199,353 | A | * | 4/1993 | Szyszko | 101/474 |
| 6,286,237 | B1 | | 9/2001 | Toutounchian | |

FOREIGN PATENT DOCUMENTS

| | | | |
|---|---|---|---|
| DE | 19812617 | A1 | 9/1998 |
| GB | 2394965 | A | 5/2004 |
| WO | 2006031065 | A1 | 3/2006 |

* cited by examiner

*Primary Examiner* — Ismael Izaguirre

(57) ABSTRACT

An ironing board assembly includes an ironing board with a main board having a substantially flat ironing surface that extends longitudinally between a first end and a second end. The ironing board assembly also includes at least one wing being integrally and movably connected to the main board and having a wing surface for extending the ironing surface of the main board.

18 Claims, 12 Drawing Sheets

IRONING BOARD ASSEMBLY WITH CONFIGURABLE IRONING SURFACE

FIELD OF THE INVENTION

The present invention relates to the field of ironing board assemblies, and more in particular to an ironing board assembly having a configurable ironing surface.

BACKGROUND

A conventional ironing board assembly may typically include an elongate, substantially rectangular ironing board that is supported by two pivotally connected, foldable legs. At one end the ironing board may have a tapering tip portion, while at an opposite end an iron rest may be provided. The ironing board may comprise a metal mesh table on an ironing side of which a cushioning and heat-dissipating felt pad may be disposed. The pad may be held in place by a textile ironing board cover, an outer side of which may provide for an ironing surface.

A drawback of such a conventional ironing board assembly is that the tapering tip of the ironing board is designed to be useful for ironing a variety of garments. As a result, it is typically not suited for any garment in particular. WO 2010/001120 (Toutounchian) acknowledges this and discloses an ironing board assembly that includes an ironing board and three wing shaped extensions. A front end of the ironing board is shaped to include three adjacent, equally spaced arcs, whereas each wing shaped attachment includes an edge having an arc that is complementary to the arcs of the ironing board. Each wing shaped attachment may be adapted to be detachably connectable to the ironing board at any of the three adjacent arcs so as to extend the ironing surface. Accordingly, wing shaped attachments may or may not be connected to the ironing board as desired to provide for a total of eight different ironing surface configurations.

WO '120 discloses that an attachment may be fitted to the ironing board by means of a tongue-and-recess provision. WO '120 further suggests that the wings may be fitted to the tip of the ironing board in other ways. The wings may, for example, be hinged to an underside of the ironing board, or the wings may slide out of the board and be retractably stored therein. Precisely what kind of fittings are envisaged here is unclear, not in the least because the application text (including its claims) stresses the fact that the attachments are adapted to detachably couple to the ironing board and no such detachable hinging or retractably-sliding fitting is described in constructional detail.

However, irrespective of the precise construction, detachably connectable attachments themselves are considered undesirable because the attachments may easily get misplaced. It is therefore an object of the present invention to provide for an ironing board assembly featuring an ironing board with an ironing surface that may be reconfigured without the use of detachable attachments.

SUMMARY OF THE INVENTION

A first aspect of the invention is directed to an ironing board assembly. The assembly comprises an ironing board, including a main board having a substantially flat ironing surface that extends longitudinally between a first end and a second end, and at least one wing, said wing being integrally and movably connected to said main board and having a wing surface for extending the ironing surface of the main board.

The ironing board assembly features an ironing board with at least one wing that is movably but inseparably/irremovably connected to the main board. Such a construction allows the wing to be reoriented relative to the main board while preventing them from being misplaced in between using different configurations. As the context implies, the term 'wing' as used in this text refers to ironing board extensions that provide for a wing surface area that is relatively small compared to the ironing surface area provided by the main board. The wing surface area of a wing may preferably be less than about one third, and more preferably one fourth, of the ironing surface area of the main board.

According to an elaboration of the ironing board assembly according to the present invention, the ironing board may include at least two wings, said wings being integrally and movably connected to said main board and having a wing surface for extending the ironing surface of the main board.

In one embodiment comprising two wings, said wings may be arrangeable to bring the ironing board in at least two alternative configurations. In a first configuration, at least one of the wings is arranged to longitudinally extend the ironing surface of the main board at its first end while none of the other wings is arranged to transversally extend the ironing surface. In a second configuration, at least two of the wings are arranged to transversally extend the ironing surface of the main board at opposite longitudinal sides, adjacent its first end, while none of the other wings is arranged to longitudinally extend the ironing surface.

In this embodiment the wings may thus allow for at least two advantageous configurations of the ironing board. In the first configuration, at least one of the wings acts as a tip wing that joins the first or front edge of the main board to longitudinally extend the ironing surface thereof. In this first configuration, no wings protrude from the longitudinal sides of the main board. Any wing that does not extend the ironing surface in the longitudinal direction is thus in a collapsed position, e.g. disposed at a non-ironing side of the main board (that is: the side of the main board facing away from the ironing surface). The one or more wings that act as the tip wing may provide the ironing board with a convexly curved or tapering front end to facilitate its insertion into narrow garment portions, such as the upper seat and pocket areas of trousers. In the second configuration, at least two wings are arranged to extend the ironing surface of the main board near the first or front end in a transverse direction. In this case, no wings protrude the front end of the ironing board: any wing that does not extend the ironing surface in the transverse direction is in a collapsed position. The second configuration offers a free-ended and relatively broad ironing surface that facilitates the ironing of, for example, back shoulder portions of shirts. It is understood that the ironing board assembly may additionally allow for other ironing board configurations besides the ones mentioned.

In another embodiment comprising two wings, the two wings may be movably, e.g. hingedly, connected to the main board at opposite longitudinal sides of a fixed, preferably tapering tip of the main board. Such an embodiment of the ironing board assembly may typically be simpler in construction and easier to operate than embodiments featuring a movable tip, while still allowing for two ironing board configurations, one of which features a preferably tapering tip for insertion into narrow garment portions, and one of which features a free-ended broad ironing surface that facilitates the ironing of, for example, back shoulder portions of shirts.

The wings may be connected to the main board in a number of ways. In one embodiment of the ironing board assembly, at least one wing is hingedly connected to the main board such that it is rotatable around a rotation axis that extends substantially parallel to the ironing surface. In another embodiment, at least one wing is hingedly connected to the main board such that it is rotatable around a rotation axis that extends substantially perpendicular to the ironing surface of the main board.

During use the ironing surface of the main board may typically extend horizontally. Rotation around an axis that extends substantially parallel to the ironing surface may thus practically amount to rotation around a horizontal axis, while rotation around an axis that extends substantially perpendicular to the ironing surface may practically amount to rotation around a vertical axis. A hinged connection between the main board and a wing that enables rotation around a single axis is reliable and simple to operate. Furthermore, such a hinged connection naturally allows a wing to be movable into a compact, collapsed position in which it is located at a non-ironing side of the main board and in which the non-ironing side of the wing faces or abuts the non-ironing side of the main board. It will be clear that in case some or all wings are movable into such a collapsed position storage of the ironing board is tight spaces will generally be easier. Hinged connections are economical to implement, for example by means of a single-degree-of-freedom hinge that is connected to the non-ironing sides (i.e. typically the undersides) of both the main board and the wing. In general, any hinge that enables rotation through angles of 90-180° or greater may be suitable for implementation; one may for example consider knuckle hinges, raised barrel hinges, electric hinges, pivot reinforced hinges, concealed hinges and friction hinges (which can be arrested at any desired angle of rotation). A hinge may be biased, for example by spring-loading, in order to force a wing into an extended or collapsed position.

In another embodiment of the present invention, one of the main board and a wing may be provided with a pivot shaft, extending in a pivot axis direction, while another one of the main board and the wing may be provided with a slotted hole for rotatably and translatably receiving at least a part of said pivot shaft. One of the main board and the wing may be provided with a tongue, extending in a direction substantially perpendicular to said pivot axis direction, while another one of the main board and the wing may be provided with a recess configured to slidably receive the tongue. The wing may be arrangeable to extend the ironing surface of the main board by first rotating it into a position in which the tongue aligns with the recess, and then sliding it towards the main board—until the wing and the main board meet—such that the tongue is supportedly received by the recess. The wing may preferably be provided with both the pivot shaft and the tongue to prevent any parts from protruding from the main board when the wing is in its collapsed position.

In yet another embodiment of the present invention, one of the main board and a wing may be provided with a bolt, while the other of the main board and the wing may be provided with a (bolt) keeper configured to engage at least part of the bolt. The bolt may be at least partly engageable by the keeper when the wing is arranged to extend the ironing surface of the main board, so as to lock this mutual arrangement of the wing and the main board. To this end, the bolt and the keeper may be movably, in particular at least slidably, arranged relatively to each other.

The terms 'bolt' and 'keeper' are to be construed broadly, and intend to include any two means that can interlock to secure or fix the wing in a position (relative to the main board) in which its wing surface extends the ironing surface of the main board, in particular such that the interlocking bolt and keeper enable sufficient support for the wing to be ironed on. The bolt may, for example, take the form of a rod, a bar, a tongue, a body with locking stud(s), etc., while the keeper may typically include a component with one or more recesses, openings, slots, passages, etc. in which the bolt is at least partly receivable.

In a preferred embodiment, at least one of the bolt and the keeper may be spring-loaded whereas the involved spring(s) may be configured to drive the bolt and the keeper into engagement with each other. A spring-loaded bolt and/or keeper may enable a convenient auto-locking feature that ensures that the two parts are forced to 'snap' into mutual engagement when the wing is arranged in a position in which it extends the ironing surface of the main board.

In another preferred embodiment the bolt may include a wedge-shaped or tapering end portion that is configured to be fittingly received by a complementarily shaped recess of the keeper. Such a locking mechanism, preferably backed by a spring-force mechanism as mentioned above, may enable a solid, stable connection between the wing and the main board. It may additionally control the precise alignment between the ironing surface of the main board and the wing surface.

In still another embodiment, the ironing board may comprise two, and no more than two wings. The two wings may be are arrangeable to bring the ironing board in at least two alternative configurations, in a first of which both wings are arranged to longitudinally extend the ironing surface of the main board at its first end, and in a second of which both wings are arranged to transversally extend the ironing surface of the main board at opposite longitudinal sides, adjacent its first end. Hence, two wings may suffice to mimic the configurability of a three-winged board.

In a particularly advantageous embodiment of the ironing board assembly, the movements of two or more wings may be coupled such that moving one of said at least two wings is accompanied by a movement of the other of said at least two wings. A first wing may for example be hingedly connected to the main board at the first end thereof, while a second and a third wing may be hingedly connected to the main board at opposite longitudinal sides thereof, and both the second and the third wing may be connected to the first wing, such that arranging the first wing in a position in which it longitudinally extends the ironing surface of the main board automatically entails folding the third and the second wings against the non-ironing sides of the main board, and vice versa. Such a construction greatly simplifies the task of changing the ironing board's configuration, in particular by reducing the number of necessary wing-rearrangement-operations.

In any of the embodiments, the movement of one or more of the wings relative to the main board may be facilitated by an ironing board cover—configured to cover both the ironing surface and any wing surfaces—that is made of a stretchable material, preferably a woven material that allows for an elongation in both its warp and weft directions of at least 50%.

These and other features and advantages of the invention will be more fully understood from the following detailed description of certain embodiments of the invention, taken together with the accompanying drawings, which are meant to illustrate and not to limit the invention.

DETAILED DESCRIPTION

Figure 1A:
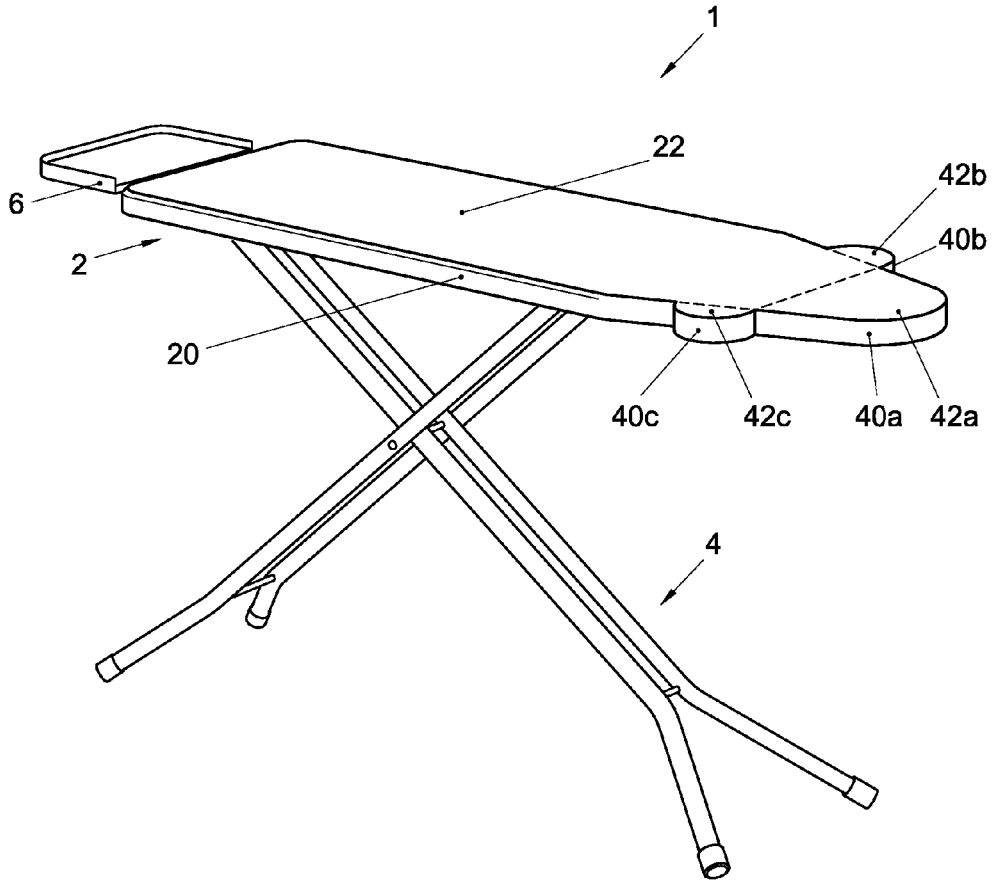
FIG. 1A is a schematic perspective view of an exemplary ironing board assembly according to the present invention, including an ironing board with a main board and three movably connected wings.

FIG. 1A is a schematic perspective view of an exemplary ironing board assembly 1 according to the present invention. The ironing board assembly 1 comprises an elongate, generally rectangular ironing board 2 that is supported by an in itself conventional foldable leg assembly 4 attached to a non-ironing or underside thereof. An optional iron rest 6 is provided at the back end of the ironing board 2.

The ironing board 2 comprises a main board 20 and three wings 40*a-c* that are movably connected thereto. A tip wing 40*a* is arranged at the front end of the main board 20 such that its wing surface 42*a* joins and extends coplanar with the ironing surface 22 of the main board. Side wings 40*b* and 40*c* are arranged at opposite longitudinal edges or sides of the main board, adjacent the front end, also such that their respective wing surfaces 42*b*, 42*c* join and extend coplanar with the ironing surface 22.

For illustrative purposes FIG. 1A shows all three wings 40 in their extended operating positions. During practical use, however, one or more of the wings 40 may be collapsed against the non-ironing side of the main board to provide for alternative ironing board configurations. In a first configuration, for example the tip wing 40*a* may longitudinally extend the ironing surface 22 while the side wings 40*b* and 40*c* may be stored in a collapsed position underneath the main board. In a second configuration, the side wings 40*b*, 40*c* may transversally extend the ironing surface 22 while the tip wing 40*a* may be folded against the non-ironing side of the main board.

Figure 1B:
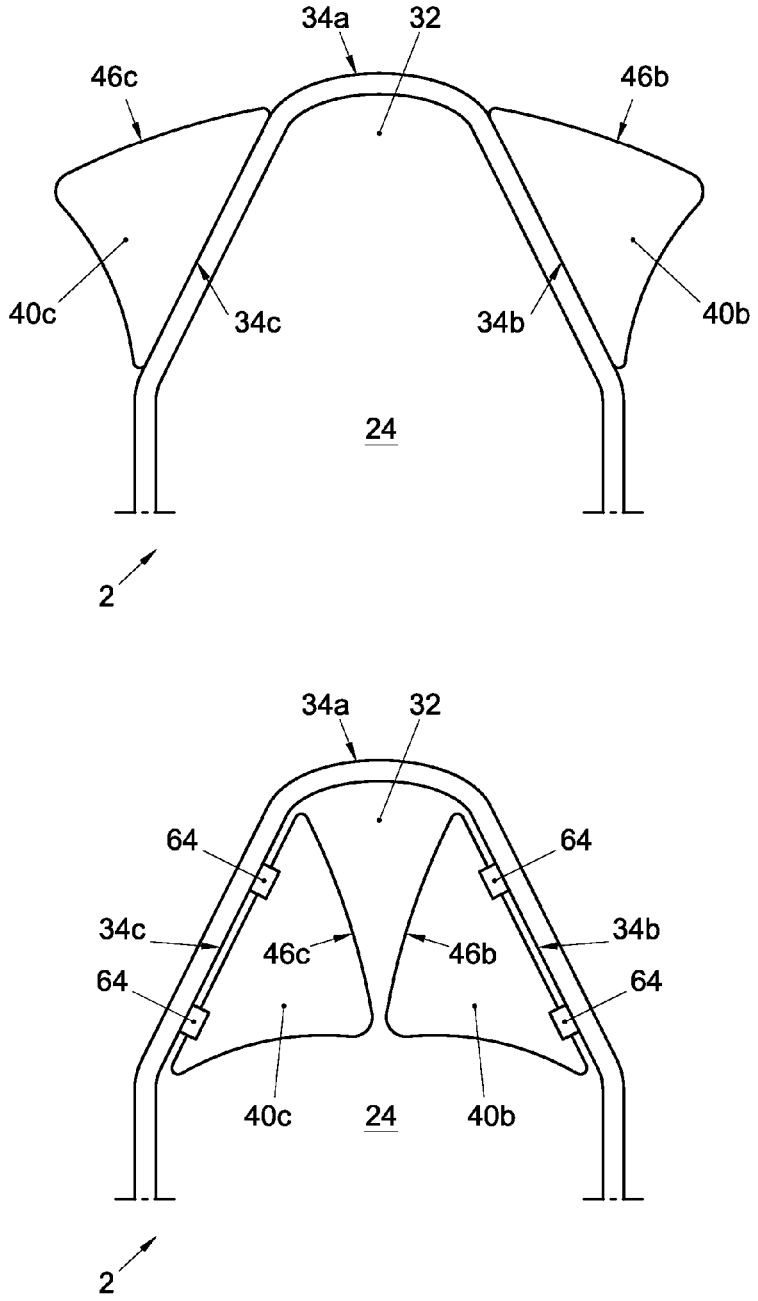
FIG. 1B is a schematic bottom view of an alternative ironing board assembly, including an ironing board with a main board and two movably connected wings.

In other embodiments of the ironing board assembly 1 according to the present invention, the number of wings 40 of the ironing board 2 may be smaller or greater than that in the embodiment of FIG. 1A, and for example equal two. In one embodiment featuring two wings, the tip wing 40*a* illustrated in FIG. 1A may be replaced by a fixed tip, such that the ironing board 2 comprises a main board 20 with a fixed tip and two side wings 40*b*, 40*c* that are movably, e.g. hingedly, connected to the main board at opposite longitudinal sides thereof, preferably adjacent the fixed tip. Such an embodiment is schematically shown in the bottom views of FIG. 1B. The depicted fixed tip 32 has two tapering substantially linear, longitudinal edges 34*b*, 34*c* that are connected by a convexly curved front edge 34*a*. A pair of hinges 64 movably connect a wing 40*b*, 40*c* to each longitudinal edge 34*b*, 34*c* of the tapering tip 32, such that the ironing board 2 can be arranged alternately in a configuration with extended wings 40*b*, 40*c*, shown in the top drawing of FIG. 1B, and in a configuration wherein the wings 40*b*, 40*c* are collapsed against the non-ironing side of the tip 32 of the ironing board 2, shown in the lower drawing of FIG. 1B. When the wings 40*b*, 40*c* are in their extended positions, their front edges 46*b*, 46*c* substantially align with the curved front edge 34*a* of the fixed tip 32, so as to extend the latter. In another embodiment, the three wings of the embodiment of FIG. 1A, i.e. the tip wing 40*a* and the side wings 40*b*, 40*c*, may be replaced by two wings that may be arranged alternately as a compound tip wing at a front end of the main board 20, and as two side wings on opposite longitudinal sides of the main board; see for an example the fifth exemplary embodiment described below with reference to FIG. 5.

In general, the wings 40 of the ironing board 2 may be connected to the main board 20 in a variety of ways. Several advantageous embodiments of a connection mechanism for movably connecting one or more wings 40 to the main board 20 will now be elucidated with reference to FIGS. 2-6. It is noted that not all embodiments to be discussed are compatible with the exemplary ironing board assembly shown in FIG. 1A. The embodiment to be discussed with reference to FIG. 5, for example, does not include three but only two wings 40, while the embodiment depicted in FIG. 6 does not allow all three wings 40*a-c* to be extended at the same time.

Figure 2C:
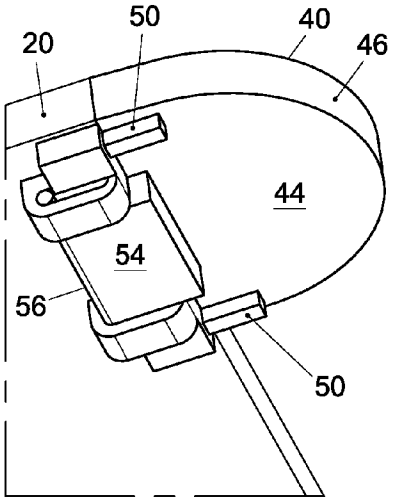
FIGS. 2A-2C schematically illustrate, in three consecutive bottom perspective views, the construction and operation of a first exemplary embodiment of a connection mechanism that connects a wing to the main board.
Figure 2B:
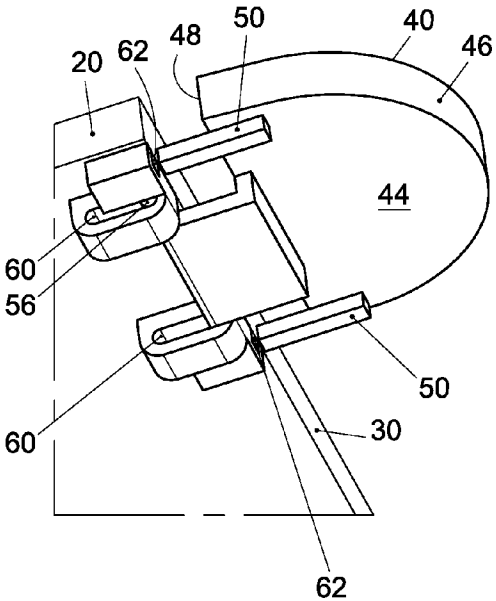
Figure 2A:
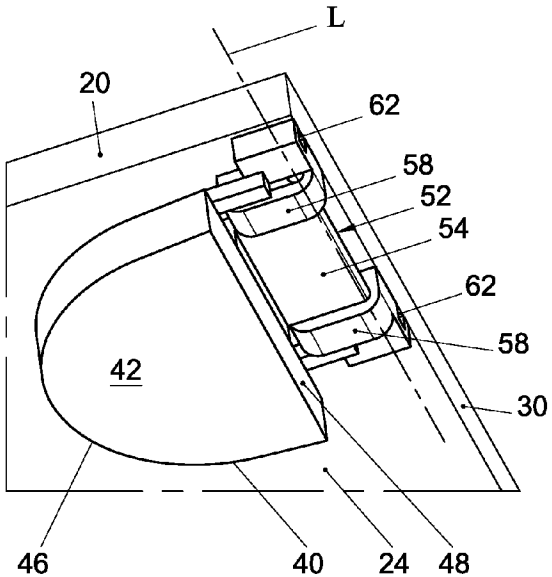

FIGS. 2A-C schematically illustrate, in three consecutive perspective bottom views, the construction and operation of a first exemplary embodiment of a connection mechanism that interconnects a wing 40 and the main board 20 of the ironing assembly 1. The mechanism is applicable to any wing 40 (i.e. side and/or tip wings), and the wing will therefore be referred to in general without any suffix.

FIG. 2A illustrates the wing 40 in its collapsed position, folded against the non-ironing side 24 of the main board 20. The wing 40 is of a generally semi-ellipsoidal shape, having a linear back edge 48 and a curved front edge 46. The curved front edge 46 is symmetric; its curvature is greatest at the center of the curve and decreases towards the extremes of the curve, such that at the very extremes the edge is about linear. The very extremes of the curved front edge 46 meet the linear back edge 48 at an approximately right angle. Two spaced apart tongues 50, fixedly attached to the non-ironing side 44 of the wing 40, protrude backwards from the wing 40. Also protruding backwards from the wing 40 is a generally T-shaped extension 52 that is fixedly attached to the non-ironing side 44 of the wing 40 at a location between the two tongues 50. A broad, long leg 54 of the T-shaped extension 52 runs essentially parallel to the two tongues 50, whereas the cross arm 56 runs in a direction substantially perpendicular thereto. As will become clear, the cross arm 56 forms a pivot shaft around which the wing 40 is rotatable. At its non-ironing side 24 the main board 20 includes two spaced apart brackets 58, one of which is a mirror image of the other. Each bracket 58 includes a slotted hole 60 that extends substantially parallel to the main board 2, and that rotatably and translatably receives an extremity of the cross arm 56 of the T-shaped extension 52 of the wing 40. Each of the brackets 58 further includes an elongate recess or slot 62, extending substantially parallel to the main board 20 and being configured to slidably receive a tongue 50. To this end, the recess 62 is at least accessible from a front side thereof.

FIGS. 2A-C jointly illustrate how the wing 40 may be brought into a position in which its wing surface 42 extends the ironing surface 22 of the main board 20. In FIG. 2A the wing 40 is still in its collapsed position, folded against the non-ironing side 24 of the main board 20 and facilitating compact storage of the ironing board assembly 1. It may be kept in this position by any suitable locking means (not shown), such as for example by two magnets disposed at opposing positions of the non-ironing sides 24, 44 of the main board 20 and the wing 40. From this collapsed position, the wing 40 may be rotated through approximately 180 degrees around the its pivot shaft 56, so as to align the wing 40 and the main board 20. See FIG. 2B. In the depicted position, the edge 30 of the main board 10 faces the back edge 48 of the wing 40. Moreover, the tongues 50 protruding from the back of the wing 40 align with the respective recesses 62. The wing 40 may now be slid inwards, driving the pivot shaft 56 backwards through the slotted holes 60 while sliding the tongues 50 into the recesses 62, until the back edge 48 of the wing 40 meets the edge 30 of the main board 20 as shown in FIG. 2C. In the situation shown in FIG. 2C, the wing's surface 42 extends the ironing surface 22 of the main board 20. The tongues 50, received in the recesses 62, provide support to the wing 40 and allow it to be ironed on.

In the embodiment of FIGS. 2A-C, the wing 40 is provided with both the pivot shaft 56 and the tongue 50, while the main board 20 includes brackets 58 that provide for pivot shaft-receiving slotted holes 60 and tongue-receiving recesses 62. In other embodiments this need not be the case. While the tongues 50 may preferably be provided on the wing 40 to eliminate unnecessary protrusions from the main board 20 when the wing 40 is in its folded position, the pivot shaft 56 and the slotted holes 60 may equally well be provided on the main board 20 and the wing 40 respectively.

Figure 3A:
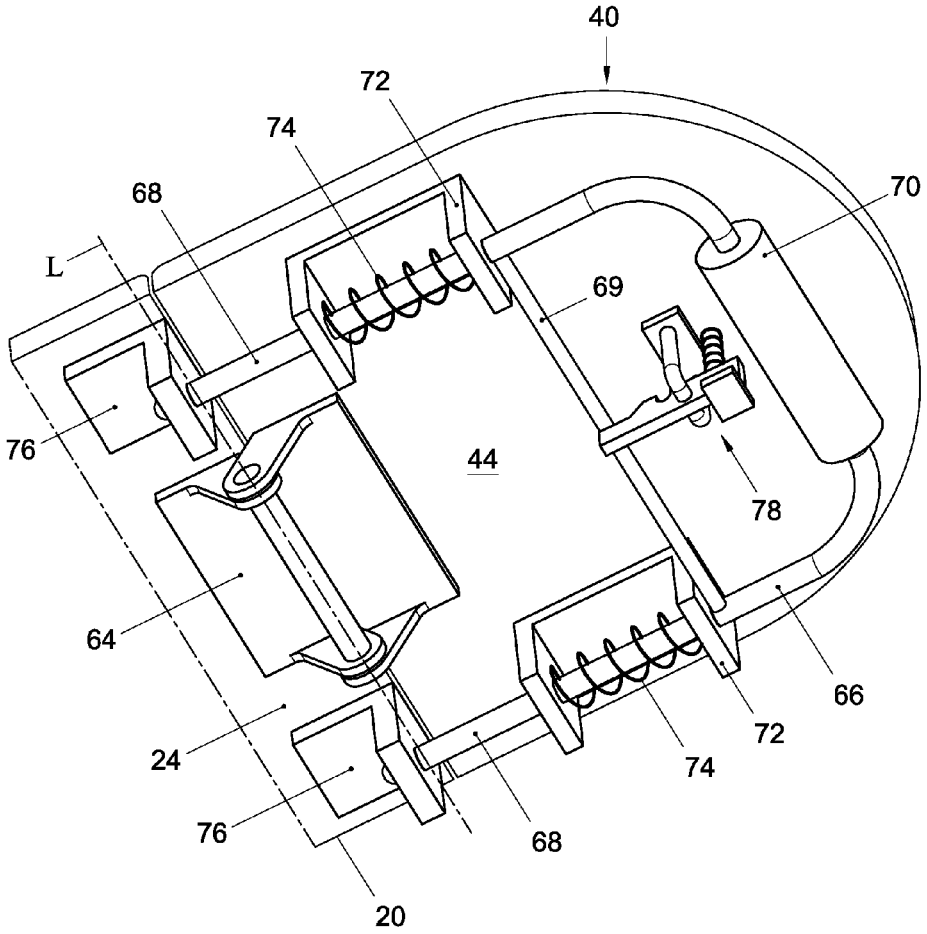
FIG. 3A schematically illustrates, in a bottom perspective view, the construction of a second exemplary embodiment of a connection mechanism that connects a wing to the main board.
Figure 3B:
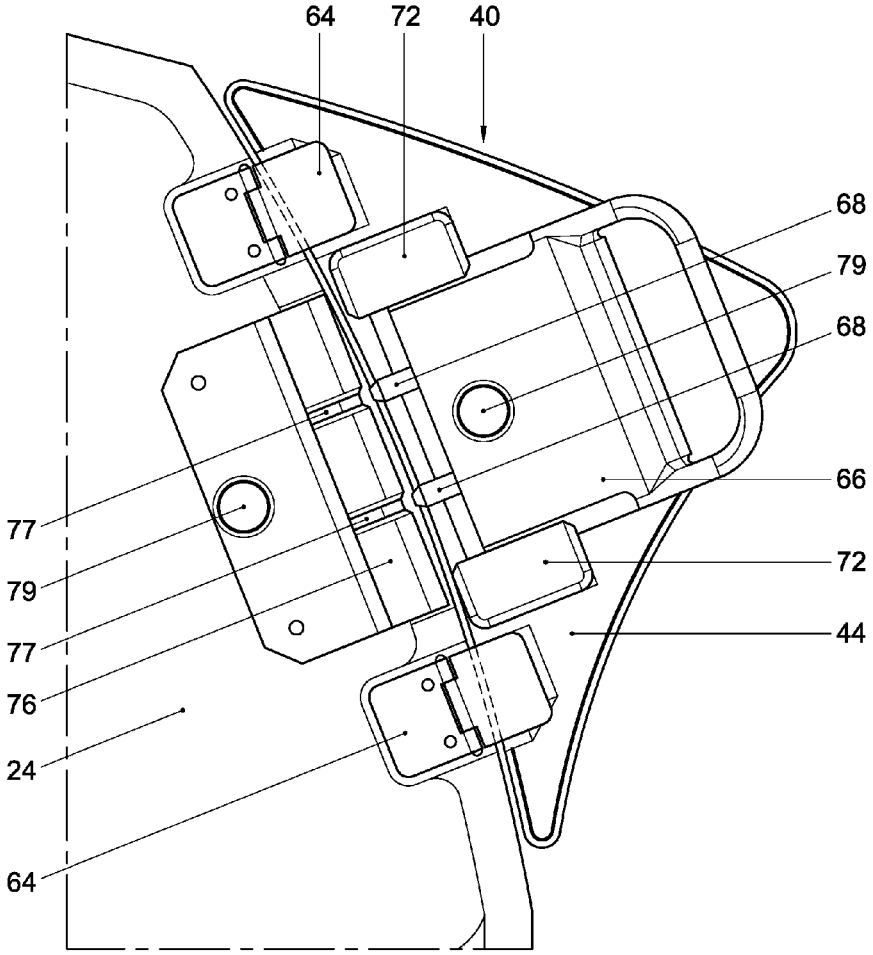
FIG. 3B schematically illustrates, in a bottom perspective view, the construction of a third exemplary embodiment of a connection mechanism that connects a wing to the main board.

FIGS. 3A and 3B schematically illustrate, in a bottom perspective view, the construction of a second respectively third exemplary embodiment of a connection mechanism that connects a wing 40 to the main board 20 of the ironing board assembly 1. In the depicted constructions, simple, one-degree-of-freedom hinges 64 connect the wing 40 and the main board 20 at their non-ironing sides 24, 44. The hinges 64 allow the wing 40 to be rotated around an axis L that runs parallel to the main board 20, such that it is movable between a collapsed position, in which the wing is folded against the non-ironing side of the main board (cf. FIG. 2A), and the operating position shown in FIG. 3A respectively FIG. 3B. In this latter position the wing's back edge abuts the front or side edge of the main board 20. As the wing 40 extends substantially coplanar with the main board 20, its wing surface 42 extends the ironing surface 22 thereof. To lock the wing 40 into its operating position, the non-ironing sides 24, 44 of the main board 20 and the wing 40 are provided with a bolt 66 and one or more keepers 76.

In the second embodiment of FIG. 3A, the non-ironing side 44 of the wing 40 is provided with a U-shaped bolt or bar 66. Each of the legs 68 of the U-shaped bolt 66 is slidably guided via a bolt guide or bracket 72 that is integrally connected to the wing 40, and that connects to the respective leg 68 via a spring 72. The non-ironing side 24 of the main board 20 is complementarily provided with a pair of keepers 76. Each of the keepers 76 provides a recess or opening configured to engage an extremity of the U-shaped bolt 66. For optimal stability, the keepers 76 are spaced apart along the direction of the rotation axis L and disposed on opposite sides of the hinge 64. When the wing 40 is arranged to extend the ironing surface 22 of the main board 20, as shown in FIG. 3A, the extremities of the U-shaped bolt 66 align with the respective recesses in the keepers 76. In this position the springs 74 force the bolt 66 towards and into engagement with the keepers 76 to lock the mutual arrangement of the wing 40 and the main board 20.

To promote the ease of operation of the U-shaped bolt 66, its short curved portion may be provided with a handle 70. In addition, releasable retention means may be provided to retain the spring-loaded bolt 66 in a position in which it is clear from the keepers 76. The retention means may for example take the form of a latch 78 that catches on a cross bar 69 provided between the legs 68 of the U-shaped bolt 66, such that when the bolt is pulled out of engagement with the keepers 76, it is automatically locked in a position in which it does not interfere with any hinging of the wing 40. Although it is possible to dispose the bolt 66 on the non-ironing side 24 of the main board 20 and the keepers 76 on the non-ironing side 44 of the wing 40, the depicted configuration is preferred as it offers a better manual accessibility and operability of the bolt 66.

In the third exemplary embodiment of FIG. 3B the non-ironing side 44 of the wing 40 may be provided with a bolt 66 in the form of a locking block. The locking block 66 may be slidably arranged between a number of, e.g. two, bolt guides in the form of slide blocks 72 that may be attached to the non-ironing side 44 of the wing 40. The sliding connection between the locking block 66 and the slide blocks 72 may preferably be such that the locking block is effectively spring-loaded, such that it is continuously driven backwards, i.e. towards the back edge of the wing 40. At its back edge, one or more elongate locking studs 68 may protrude from the locking block 66. In the depicted embodiment, the locking studs 68 have a substantially cylindrical shape, while their free, backward pointing extremities have a tapering or wedge-shaped profile. At its forward end, the locking block 66 may feature an integrated handle 70. The non-ironing side 24 of the main board 20 may be provided with a keeper 76. The keeper 76 may include a substantially cylindrical portion into which tangentially extending guide-grooves 77 may be provided, one for each of the locking studs 68 of the locking block 66. At the front or outward facing side of the cylindrical portion of the keeper 76, the guide-grooves 77 may end in radially extending locking stud-receiving slots (not visible), which may in particular be shaped to snugly receive the tapering or wedge-shaped extremities of the locking studs 68. Both the keeper 76 and the locking block 66 may further be provided with magnets 79 that may attract each other when the wing 40 in its collapsed position, so as to lock said wing in said position. In an alternative embodiment, the magnets 79 may be replaced with other catch means configured to hold the wing in the collapsed position, such as for example mechanical snaps or catches, or plastic or metal hooks.

The operation of the third embodiment of FIG. 3B is similar to that of the second embodiment of FIG. 3A. A noteworthy distinction is that the locking studs 68 of the locking block 66, by virtue of the spring-loaded suspension of the latter in the slide blocks 72, are continuously made to slide in the guide-grooves 77 of the keeper 76 during rotation of the wing 40 from its collapsed position to its operation position, and vice versa. This guiding of the locking studs 68 ensures that they accurately register with the locking stud-receiving slots in the keeper 76 once a wing 40 that is being extended reaches its operating position. At that point, the locking studs 68 are forced into their complementary shaped receiving slots to firmly arrest and lock the wing 40.

Figure 4C:
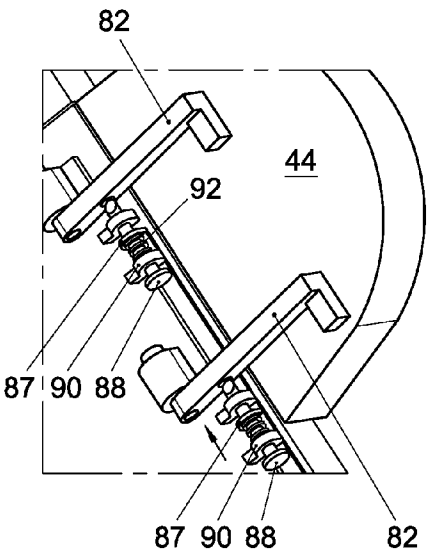
FIGS. 4A-4C schematically illustrate, in three consecutive bottom perspective views, the construction and operation of a fourth exemplary embodiment of a connection mechanism that connects a wing to the main board.
Figure 4B:
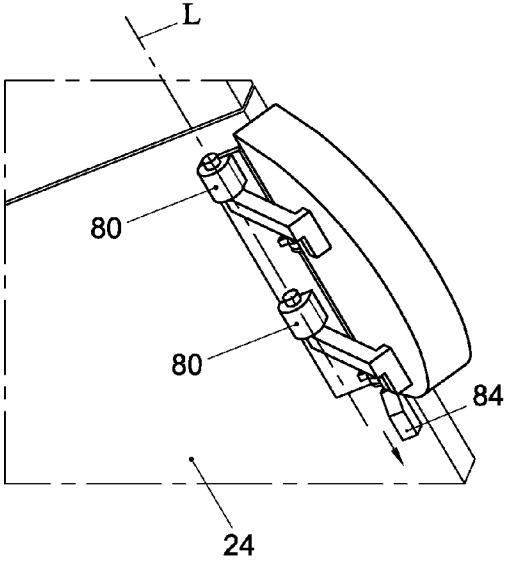
Figure 4A:
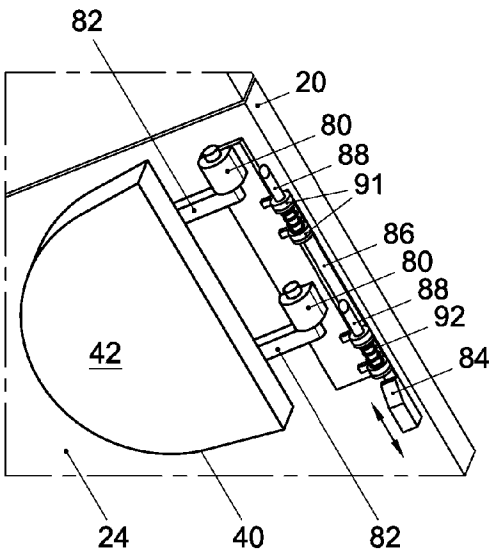

FIGS. 4A-C schematically illustrate, in three consecutive perspective views, the construction and operation of a fourth exemplary embodiment of a connection mechanism that connects a wing 40 to the main board 20. The fourth exemplary embodiment is similar to the third exemplary embodiment of FIG. 3B in that the wing 40 is connected to the main board 20 through two one-degree-of-freedom hinges. The hinges are formed by two spaced apart brackets 80 that define a cylindrical opening, each of which openings receives an angular end of one of two crank- or elongated-S-shaped support bars 82 that are connected to the non-ironing side 44 of the wing 40 and protrude from the back thereof.

As in the second and third exemplary embodiments of FIG. 3A-B, the fourth embodiment of FIGS. 4A-C also includes a spring-loaded bolt 84 for locking the mutual arrangement of the main board 20 and the wing 40 when the latter is in its operating position (see FIG. 4C). The spring-loaded bolt 84 includes a slide 86 onto which two relatively small elongate bolts 88 are provided at different positions along its length. Each of the small bolts 88 extends in the longitudinal direction of the slide 86 and includes a beveled or tapering tip. Two guide brackets 90 for guiding the small bolts 88 are disposed on the non-ironing side 24 of the main board 20. Each guide bracket 90 includes a pair of spaced apart rings. Each small bolt 88 extends through the pair of rings 91 of a respective guide bracket 90, such that a stop surface 87 via which the small bolt 88 is connected to the slide 86 is disposed between the rings 91 of the respective bracket 90. A compression spring 92 is provided between each stop surface 87 and one of the guide bracket rings 91, so as to spring-load the small bolt 88 and the slide 86 to which it is attached. The aforementioned support bars 82, which serve as keepers for the spring-loaded bolt 84, are both provided with a recess capable of receiving at least an extremity of a small bolt 88.

When the wing 40 is turned from its collapsed position, shown in FIG. 4A, to its operating position, shown in FIG. 4C, the support bars 82 of the wing 40 are forced into contact with the beveled tips of the small bolts 88. This forces the small bolts 88, and hence the spring-loaded bolt 84 as a whole, backwards against the spring force. As the wing 40 reaches its operating position, the recesses in the support bars 82 align with the tips of the small bolts 88 (cf. FIG. 4C), and the spring-loaded bolt 84 is allowed to snap forward, driving the small bolts 88 into the recesses to lock the wing 40 in place. To unlock the wing 40 a user may simply pull the slide 86 backwards against the spring force to withdraw the small bolts 88 from the recesses in the support bars 82, thereby releasing the wing 40 for rotation.

Figure 5A:
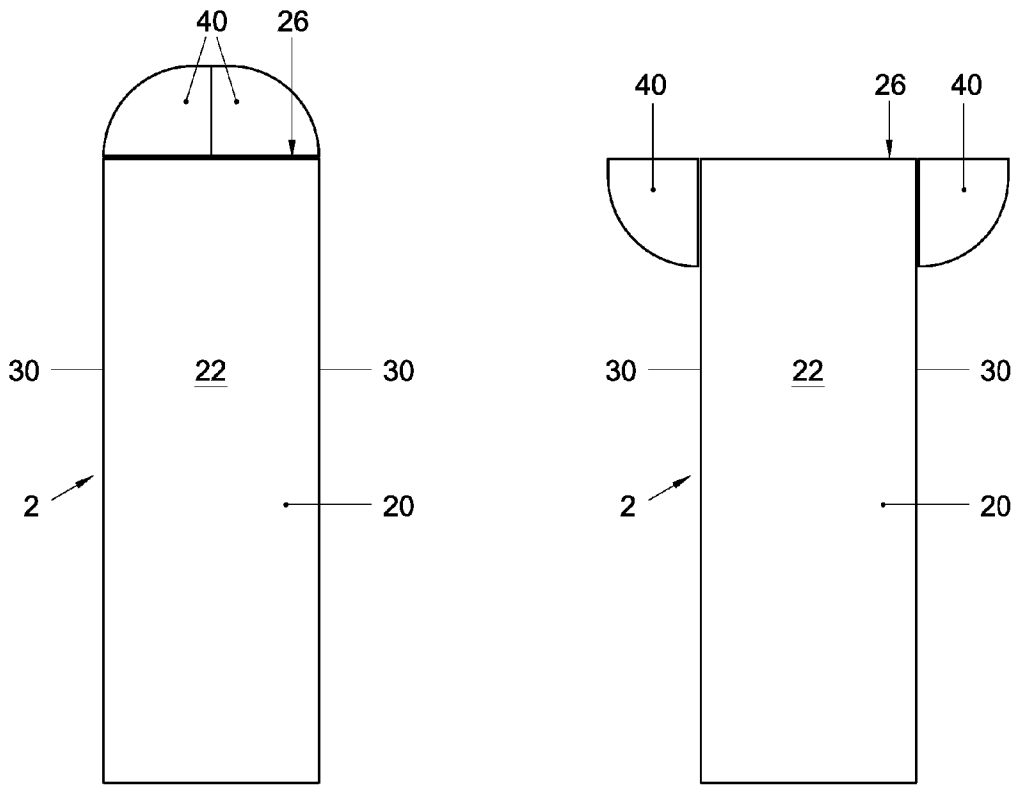
FIGS. 5A-5D schematically illustrate, in one top view (FIG. 5A) and three consecutive bottom views, (FIGS. 5B-5D), a fifth exemplary embodiment of a connection mechanism that connects a wing to the main board.

FIG. 5A schematically illustrates a fifth embodiment of an ironing board assembly according to the present invention. It depicts two top views of an ironing board 2 comprising a main board 20 and two wings 40. The two wings 40 are not arrangeable between a collapsed position (in which the wings are typically folded against the non-ironing side of the main board) and an operating position, but between two operating positions.

Each of the two wings 40 is of a generally quarter-ellipsoidal shape, having two mutually perpendicularly extending linear edges that are connected by an ellipsoidally curved front edge. In the top view of the ironing board 2 shown on the left of FIG. 5A, the two wings 40 are arranged at the front end 26 of the main board 20 to form a semi-ellipse that longitudinally extends the ironing surface 22 thereof. The two wings 40 join each other along one of their respective linear edges while their other linear edges align and meet with the linear front edge 26 of the ironing board 2. This configuration of the ironing board 2 is particularly useful for ironing, for example, the seat and tops of legs of trousers. In the top view of the ironing board shown on the right of FIG. 5A, the two wings 40 are alternatively arranged on opposite longitudinal sides of the main board 20. One of their respective linear edges aligns with the front edge 26 of the main board, while the other meets with a respective longitudinal side 30 thereof. The wings 40 thus transversally extend the ironing surface 22 of the main board 20 adjacent its front end 26. This configuration is particularly useful for ironing, for example, the shoulder portion of shirts.

Figure 5D:
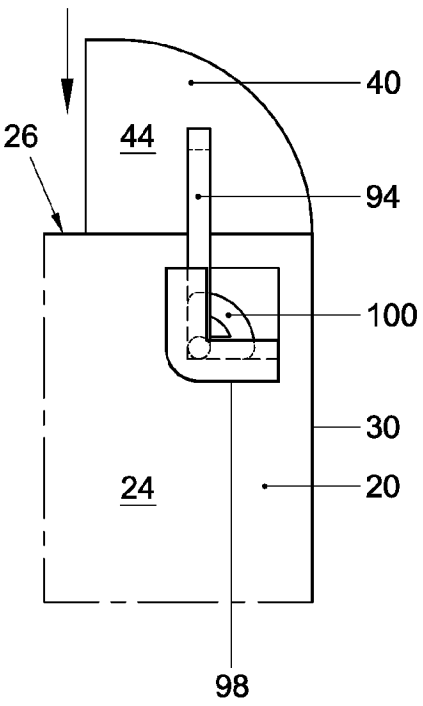
Figure 5C:
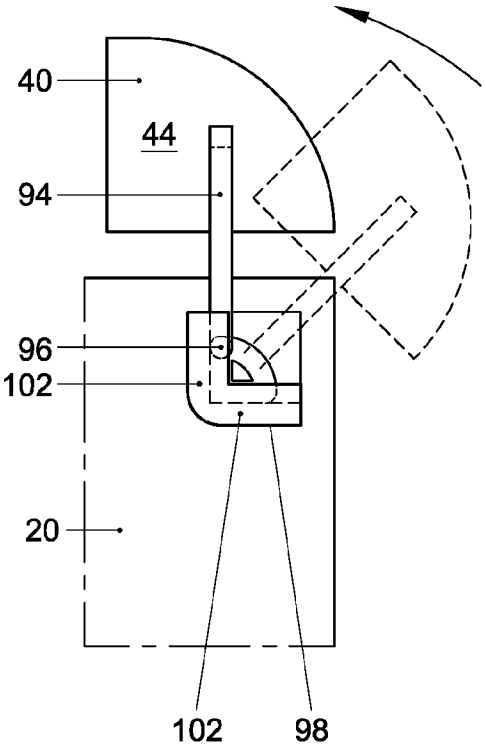
Figure 5B:
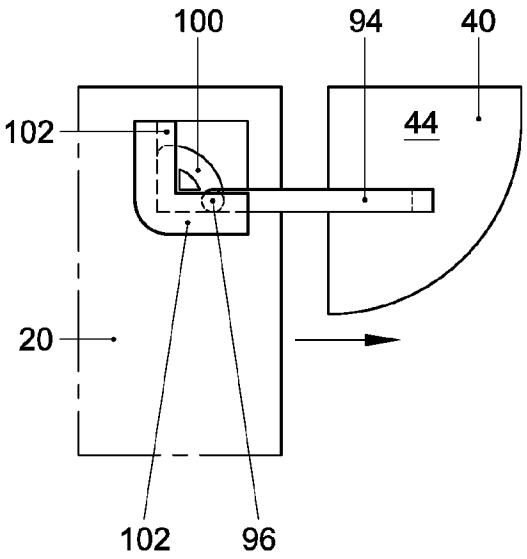

FIGS. 5B-D illustrate in a series of bottom views how a wing 40 is connected to the main board 20. The wing 40 includes an elongate support bar 94 that is attached to a non-ironing side of the wing 44 and that protrudes from a back side thereof, across one of its linear edges. The protruding free end of the support bar 94 includes a guide head 96 that is engaged by a guide bracket 98 mounted on the non-ironing side 24 of the main board 20. The guide bracket 98 provides a quarter-circularly shaped slot 100 configured to receive and guide the guide head 96. The slot 100 comprises two equally long, mutually perpendicularly extending linear slot parts that are connected by a circularly curved slot part. The two linear slot parts extend perpendicularly to the front edge 26 and the neighboring longitudinal edge 30 of the main board 20 respectively. Furthermore, each linear slot part is provided with a force support surface 102 that roofs over said slot part.

When the wing 40 is in an operating position such that it joins the main board 20 along one of its linear edges (cf. FIG. 5A (right drawings)), the support bar 94 of the wing 40 extends into the guide bracket 98, in parallel with a linear slot part. The force support surface 102 that covers the respective linear slot part then provides support to the support bar 94, allowing the wing surface 42 to be ironed on. To change the configuration of the ironing board 2, the wing 40 may first be pulled outwards (cf. FIG. 5B) relative to the main board 20. In doing so, the guide head 96 provided at the end of the support bar 94 slides outwards through the linear guide part until it reaches the extremity of the quarter-circularly-shaped slot part. Now the wing 40 may be revolved around the corner of the ironing board (FIG. 5C) by turning the wing 40 and sliding the guide head 96 of its support bar 94 through the circularly curved slot part of the guide bracket 98. The reorientation of the wing 40 ends when the guide head 96 reaches the other extremity of the circularly curved slot part. The wing 40 may then be pushed inwards again relative to the main board 20, sliding the guide head 96 into the other of the linear slot parts and the support bar 94 into full engagement with the associated force support surface 102 (FIG. 5D).

Generally, the ironing board 2 of the ironing board assembly 1 according to the present invention includes a number of wings 40 that may be operated independently. That is, each of the wings 40 may either be arranged to extend the ironing surface 22 of the main board 20 or be brought into a collapsed position independently of the arrangement of the other wings. In such embodiments, however, changing the ironing board's configuration—e.g. from one featuring an extended tip 40*a* wing plus collapsed side wings 40*b*, 40*c* into one featuring a collapsed tip wing 40*a* plus extended side wings 40*b*, 40*c*—requires a number of separate readjustment acts to be carried out by the user. This may be perceived as inconvenient, especially because different configurations may be useful for ironing different portions of the same garment. To facilitate rearrangement of the ironing board's configuration, in particular by reducing the number of involved operations, the operation of two or more wings 40 may be coupled.

For example, in one embodiment of the ironing board 2 featuring a tip wing 40*a* and two side wings 40*b*, 40*c*, the two side wings may be coupled such that the one automatically mirrors the (position and motion of the) other. The operation of the side wings 40*b*, 40*c* may be coupled using any suitable means, either fully mechanical, or partly mechanical and partly electronic. Of course, not only side wings but any two or more wings 40 may be coupled.

Figure 6B:
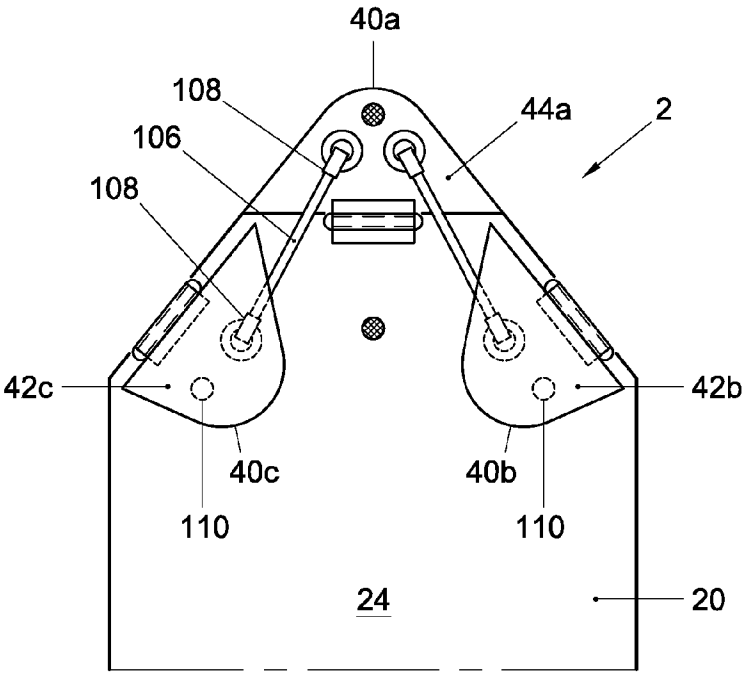
FIGS. 6A-6B schematically illustrate, in perspective view, an exemplary sixth embodiment of an ironing board assembly according to the present invention, wherein the wings are mutually connected to synchronize their movements.
Figure 6A:
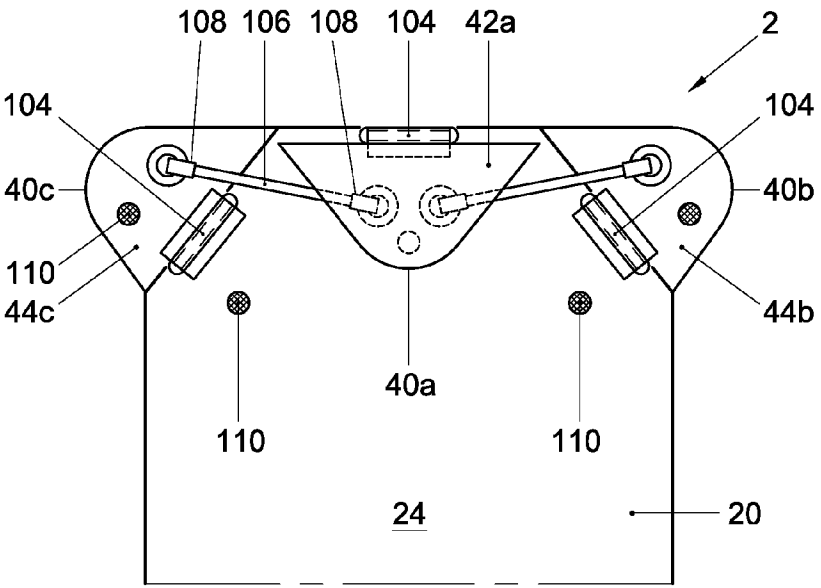

FIGS. 6A-B schematically illustrate, in bottom views, an exemplary sixth embodiment of an ironing board 2 wherein the tip wing 40*a* and the two side wings 40*b*, 40*c* are mutually connected by mechanical means to synchronize their operation. Each of the wings 40*a-c* is connected to the main board 20 by means of a one-degree-of-freedom-hinge 104 that is attached to their non-ironing sides 24, 44*a-c*. Each side wing 40*b*, 40*c* is further connected to the tip wing 40*a* by means of a three-part linkage 106 that includes two universal joints 108. The extremities of the linkages connect to the non-ironing sides 44*a-c* of the wings 40*a-c*.

FIG. 6A illustrates the configuration of the ironing board 2 wherein the two side wings 40*b*, 40*c* are extended while the tip wing 40*a* is collapsed against the non-ironing side 24 of the main board 20. Two magnets 110, disposed at opposing locations at the non-ironing sides of the main board 24 and the tip wing 44*a*, make contact and lock the tip wing 40*a* in its collapsed position. Due to the fact that tip wing 40*a* is connected to either side wing 40*b*, 40*c* by means of a said linkage 106, the position of the side wings 40*b*, 40*c* is locked as well. The ironing board's configuration may be changed easily into that illustrated by FIG. 6B by rotating the tip wing 40*a* from its collapsed position into its extended position. The linkages 106 ensure that this outward motion of the tip wing 40*a* is accompanied by an inward collapse of the side wings 40*b*, 40*c*. Magnets 110 provided at opposite locations of the non-ironing sides of the main board 24 and the side wings 44*b*, 44*c* may ensure that the side wings 40*b*, 40*c*, and hence also the tip wing 40*a*, are kept in position.

Figure 7A:
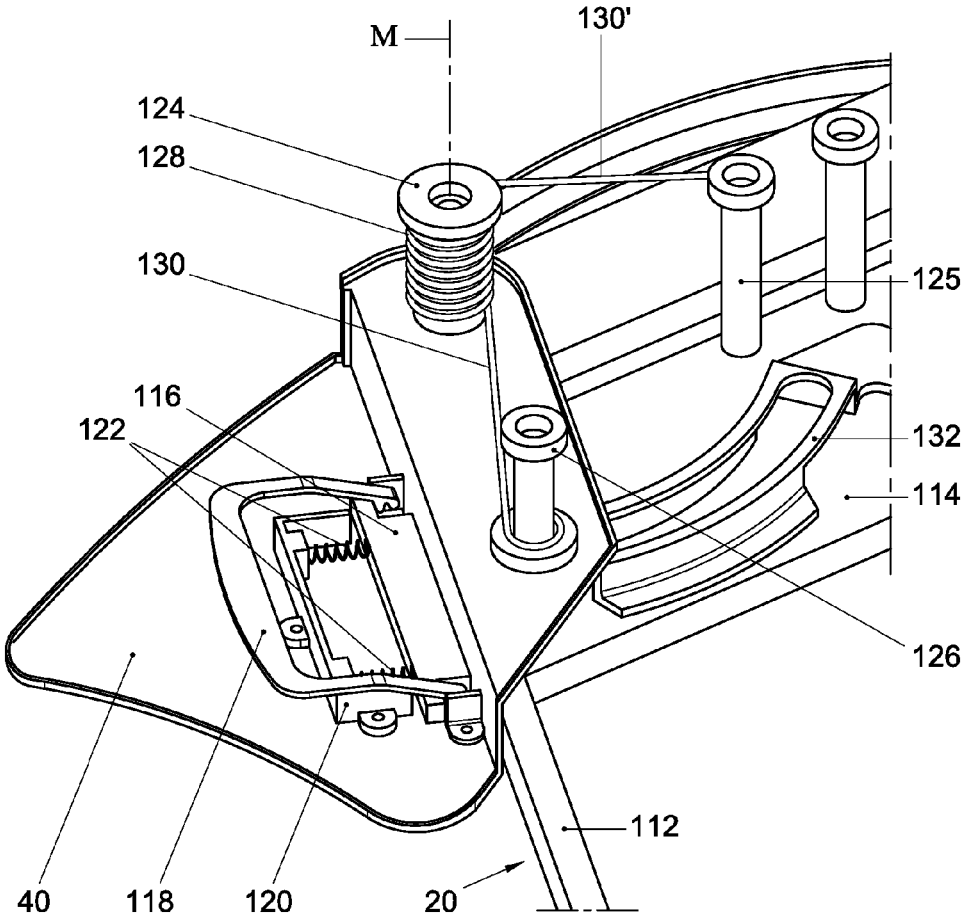
FIGS. 7A-7C schematically illustrate, in three consecutive bottom perspective views, the construction and operation of a seventh exemplary embodiment of a connection mechanism that connects a wing to the main board.
Figure 7B:
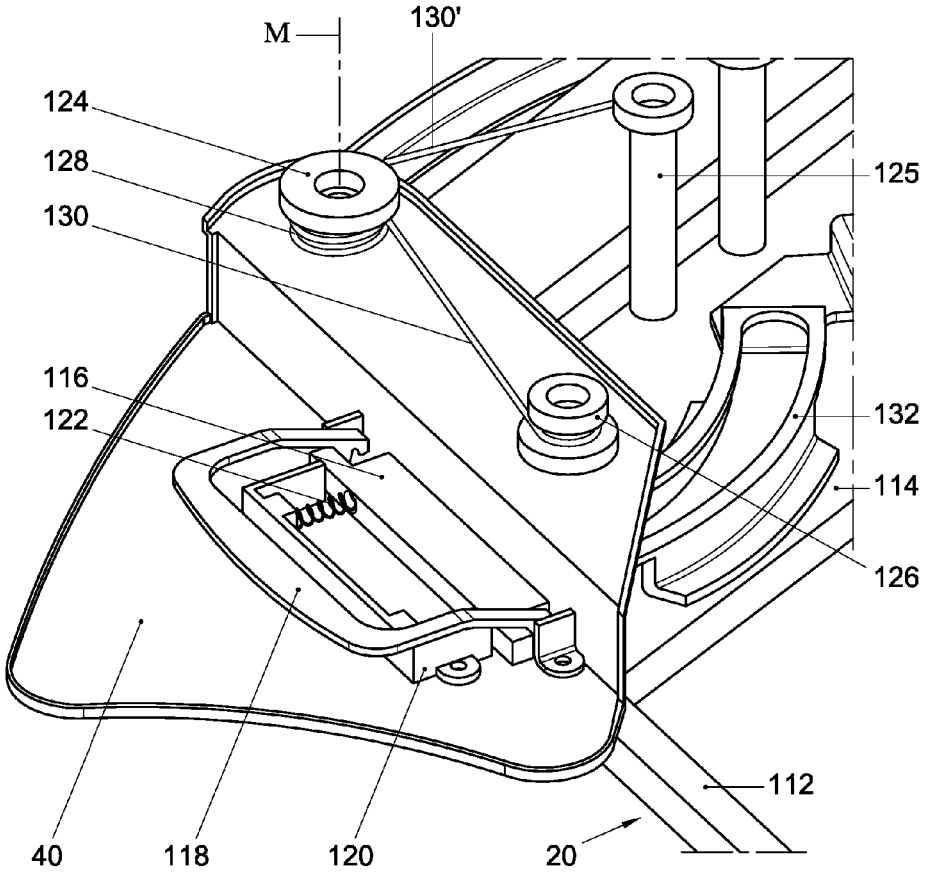
Figure 7C:
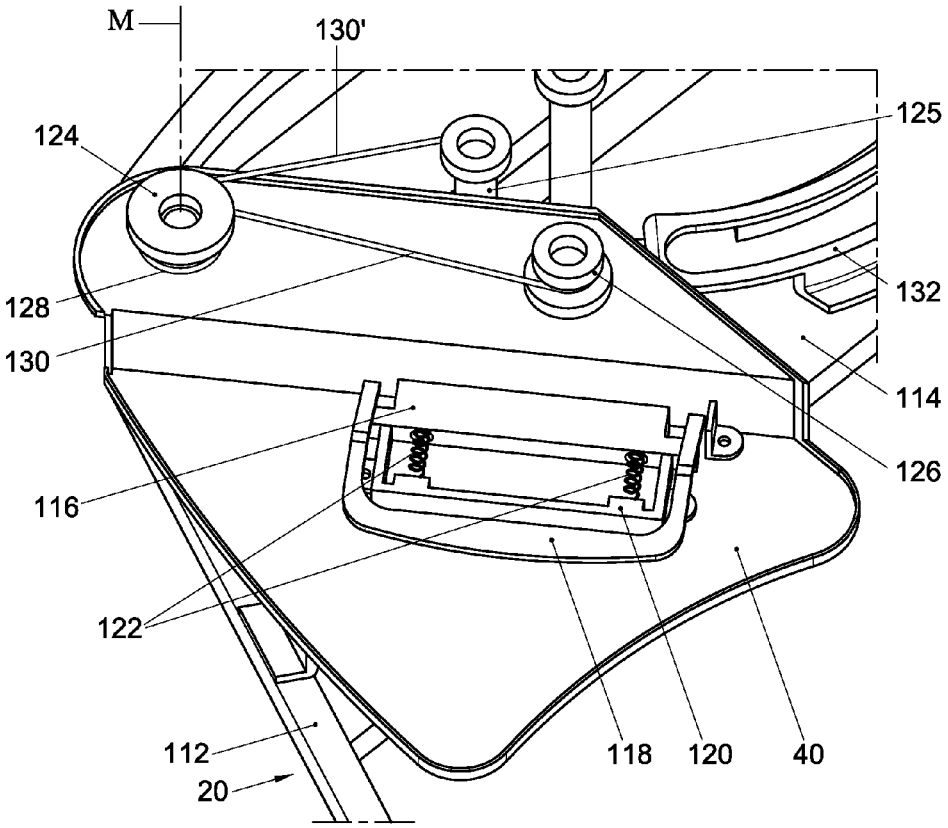

FIGS. 7A-C schematically illustrate in three consecutive bottom perspective views the construction and operation of a seventh exemplary embodiment of a connection mechanism that may connect a wing 40 to the main board 20. In this seventh embodiment the wing 40 may be movable between an extended and a collapsed position by both translation along and rotation about an axis M that extends substantially perpendicular to the main board 20, and hence to the ironing surface 22 thereof (not visible in FIGS. 7A-C).

As shown in FIGS. 7A-C, the main board 20 may comprise an outer frame 112 that defines the contour of main board, and a support plate 114 that is mounted inside said frame 112. Fixedly attached to the support plate 114 may be a pivot pin 124, a reaction pin 125 and a slotted guide 132. The pivot pin 124 may extend along the axis M and through the wing 40, such that the wing 40 is both movable along and rotatable around the pivot pin 124. The wing 40 may further be fitted with a guide pin 126 that is slidably connected thereto. One end of the guide pin 126 (the end not visible in FIGS. 7A-C) may be configured for cooperation with the slotted guide 132, such that said end may be guided through a circle segment-shaped slot provided therein. It will be clear from FIGS. 7A-C that a radius of the circle segment-shaped slot of the slotted guide 132 may correspond to a distance between the pivot pin 124 and the guide pin 126, such that the guide pin 126 and the slotted guide 132 may facilitate rotation of the wing 40 around the central axis M of the pivot pin 124.

To bias the rotational movement of the wing 40, a V-spring 128 may be provided between a bottom surface of the wing 40 and a head of the pivot pin 124. A first leg 130 of the V-spring 128 may be connected to the guide pin 126, while a second leg 130' may be connected to the reaction pin 125. The configuration may be such that the V-spring continually forces the wing 40 to rotate inwards, towards its collapsed position underneath the main board 20; the inward rotation may be halted when the guide pin 126 touches the inner end of the slot of the slotted guide 132. In addition to driving the inward rotational movement of the wing, the V-spring 128 may further drive an upward (i.e. downward in the bottom views of FIGS. 7A-C) translational movement of the wing 40 along the central axis M of the pivot pin 124. This will be clarified below where the operation of the seventh embodiment is discussed.

The non-ironing side of the wing 40 may also be provided with a locking mechanism to lock the wing 40 in its extended position relative to the main board 20. The locking mechanism may for example comprise a spring-loaded slidable bolt 116, one or more compressive springs 122 provided in a spring holder 120 to bias the bolt 116, and an operating handle 118 to operate the bolt 116, in particular to facilitate moving it against the spring force exerted on it by the compressive springs 122. The bolt 116 may extend through an opening in a normally vertically extending portion of the wing 40, such that an inward portion of the bolt 116 (not visible in FIGS. 7A-C) may releasably engage a keeper (not visible in FIGS. 7A-C), e.g. a slot or recess, provided in or on the main board frame 112.

The operation of the seventh embodiment may be described as follows, starting from the extended-wing-configuration depicted in FIG. 7A. In the situation of FIG. 7A the bolt 116 extends through the wing 40 to engage a keeper (not visible) of the main board 20, so as to lock the wing in its extended position. By tilting the handle 118 the bolt 116 may be made to slide backwards against the spring force of the compression springs 122, and the locking engagement between the bolt 116 and the keeper may be released. As a second step, the wing 40 may be moved downwards (i.e. upwards in the bottom views of FIGS. 7A-C) along the pivot pin 124 and the guide pin 126, into the configuration shown in FIG. 7B. Due to the presence of the V-spring 128 between the bottom surface of the wing 40 and the head of the pivot pin 124, this downward movement of the wing requires a little force (necessary to compress the coil of the V-spring 128 along its axis). Once the entire wing 40 is disposed below the bottom level of the main board 20, the V-spring 128 will force the inward rotation of the wing 40 around the central axis M of the pivot pin 124, into its collapsed position shown in FIG. 7C. It is understood that the above procedure may be executed in reverse to move the wing from its collapsed into its extended position, in which case the locking mechanism will eventually auto-lock the wing 40 in the orientation of FIG. 7A.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments.

LIST OF ELEMENTS

1 ironing board assembly
2 ironing board
4 foldable leg assembly
6 iron rest
20 main board
22 ironing surface
24 non-ironing side of main board
26 first or front end/edge of main board
28 second or back end/edge of main board
30 longitudinal edge of main board
32 fixed tip of main board
34*a,b,c* front (a) and longitudinal (b,c) sides of fixed tip
40*a,b,c* front (a) and side (b,c) wings
42 wing surface
44 non-ironing side of wing
46 front edge of wing
48 back edge of wing
FIG. 2A-C:
50 tongue
52 T-shaped extension
54 long leg of T-shaped extension 54
56 cross arm of T-shaped extension 54/pivot shaft
58 bracket
60 slotted hole in bracket 58 for receiving pivot shaft 56
62 recess for receiving tongue 50
FIG. 3A-B:
64 one degree-of-freedom hinge
66 bolt
68 leg of U-shaped bolt (FIG. 3A)/locking stud (FIG. 3B)
69 cross bar of U-shaped bolt (FIG. 3A)
70 bolt handle
72 bolt guide
74 spring for spring-loading bolt (FIG. 3A)
76 keeper
77 guide-groove in keeper (FIG. 3B)
78 releasable retention means (FIG. 3A)
79 magnets (FIG. 3B)
FIG. 4A-C:
80 bracket
82 support bar
84 spring loaded bolt
86 slide of spring loaded bolt 84
87 stop surface of slide 86 connecting to small bolt 88
88 small bolts mounted on slide 86
90 guide bracket
91 ring of guide bracket 90
92 spring
FIG. 5A-D:
94 support bar
96 guide head of support bar 94
98 guide bracket
100 quarter-circularly shaped slot of guide bracket 98
102 force support surface of guide bracket 98
FIG. 6A-B:
104 hinge
106 three part linkage
108 universal joint of linkage 106
110 magnet
FIG. 7A-C:
112 main board frame
114 support plate, mounted inside main board frame
116 bolt
118 bolt operating handle
120 spring holder
122 compressive springs
124 pivot pin
125 reaction pin
126 guide pin
128 V-spring
130, 130' leg of V-spring
132 slotted guide for guide pin 126
L rotation axis, parallel to ironing surface
M rotation axis, perpendicular to ironing surface
a,b,c a suffix a,b,c denotes reference to a tip wing/edge (a) or a side wing/edge (b,c)

The invention claimed is:

1. An ironing board assembly comprising:
an ironing board, including:
a main board having a substantially flat ironing surface that extends longitudinally between a first end and a second end;
a wing integrally and movably connected to said main board and having a wing surface for extending the ironing surface of the main board; and
a further wing hingedly connected to the main board for rotation around a rotation axis that extends substantially parallel to the ironing surface,
wherein the wing is pivotally connected to the main board for rotation around a rotation axis that extends substantially perpendicular to the ironing surface.

2. The ironing board assembly according in to claim 1, wherein each of said wing and said further wing is integrally and movably connected to said main board and having a wing surface for extending the ironing surface of the main board.

3. An ironing board assembly, comprising;
ironing board, including:
a main board having an ironing surface that extends longitudinally between a first end and a second end; and
at least two wings, each of said at least two wings being integrally and movably connected to said main board and having a wing surface for extending the ironing surface of the main board, wherein the at least two wings are arrangeable to bring the ironing board in at least two alternative configurations, in a first configuration at least one wing of the at least two wings is arranged to longitudinally extend the ironing surface of the main board at a first end of the main board while none of other wings is arranged to transversally extend the ironing surface, and in a second configuration the at least one wing is arranged to transversally extend the ironing surface of the main board at opposite longitudinal sides adjacent the first end while none of the other wings is arranged to longitudinally extend the ironing surface,
wherein at least one of the two wings rotates around a rotation axis that extends substantially parallel to the ironing surface of the main board.

4. The ironing hoard assembly according to claim 2, wherein said wing and sad further wing are movably connected to the main board at opposite longitudinal sides of a fixed, tapering tip of the main board.

5. The ironing board assembly according to claim 1, wherein the wing is movable into a collapsed position in with it is located at a non-ironing side of the main board.

6. The ironing board assembly according to claim 1, wherein one of the main board and the wing is provided with a pivot shaft extending in a pivot axis direction, while another one of the main board and the wing is provided with a slotted hole for rotatably and translatably receiving at least a part of said pivot shaft, wherein one of the main board and the wing is provided with a tongue, extending in a direction substantially perpendicular to said pivot axis direction, while another one of the main board and the wing is provided with a recess configured to slidably receive the tongue, and wherein the wind is arrangeable to extend the ironing surface of the main board by first rotating the wing into a position in which the tongue aligns with the recess, and then sliding the wing towards the main board such that the tongue is supportedly receive by the recess.

7. The ironing board according to claim 1, wherein one of the main board and the wing is provided with a bolt, and wherein the other of the main board and the wing is provided with keeper configured to engage at least part of the bolt and wherein the bolt is at least partly engageable by the keeper when the wing is arranged to extend the ironing surface of the main board so as to lock a mutual arrangement of the wing and the main board.

8. The ironing board according to claim 7 wherein at least one of the bolt and the keeper is spring-loaded, and wherein a spring driving the at least one of the bolt and the keeper is configured to force the bolt into engagement with the keeper.

9. The ironing board according to claim 7, wherein the bolt includes a wedge-shaped or tapering end portion that is configured to be fittingly received by a complementarily shaped recess of the keeper.

10. The ironing board assembly according to claim 7, wherein the bolt is slidably connected to a non-ironing side of the wing, and wherein the keeper is disposed on a non-ironing side of the main board, said keeper having a recess or opening for receiving an end of the bolt.

11. The ironing board assembly according to claim 1, wherein the ironing board comprises two, and no more than two wings.

12. An ironing board assembly, comprising:

an ironing board, including:

a main board having an ironing surface that extends longitudinally between a first end and a second end; and at least two wings, each of said wings being integrally and movably connected to said main board and having a wing surface for extending the ironing surface of the main board, wherein said at least two wings are arrangeable to bring the ironing board in at least two alternative configurations, in a first configuration the at least two wings are arranged to longitudinally extend the ironing surface of the main board at a first end of the main board and to have an entire edge of each of the at least two wings contact each other, and in a second configuration the at least two wings are arranged to transversally extend the ironing surface of the main board at opposite longitudinal sides, adjacent the first end, the entire edge extending from a proximate end of each of the at least two wings near the main board to a distal end of each of the at least two wings away from the main board.

13. An ironing hoard assembly including an ironing board, the ironing board comprising:

a main board having a substantially flat ironing surface that extends longitudinally between a first end and a second end;

a wing integrally and movably connected to said main board and having a wing surface for extending the ironing surface of the main board; and a further wing, wherein movements of the wing and the further wing are coupled such that moving one of the wing and the further wing is accompanied by a movement of another of the wing and the further wing.

14. An ironing board assembly, comprising;

an ironing board, including;

a main board having a substantially flat ironing surface that extends longitudinally between a first end and a second end;

a wing with connecting means for integrally and movably connecting the wing to said main board and having a wing surface for extending the ironing surface of the main board; and a further wing;

wherein movements of the wing and the further wing are coupled such that moving one of the wing and the further wing is accompanied by a movement of another of the wing and the further wing, and wherein the wing is pivotally connected to the main board for rotation around a rotation axis that extends substantially perpendicular to the ironing surface.

15. The ironing board assembly according to claim 14, wherein the connecting means include a bolt provided on one of the main board and the wing, and a keeper provided on another of the main board and the wing, wherein the keeper is configured to engage at least part of the bolt, and wherein the bolt is at least partly engageable by the keeper when the wing is arranged to extend the ironing surface of the main board for locking a mutual arrangement of the wing and the main board.

16. The ironing board assembly according to claim 15, wherein at least one of the bolt and the keeper is spring-loaded, and wherein a spring driving the at least one of the bolt and the keeper configured to force the bolt into engagement with the keeper.

17. The ironing board assembly according to claim 15, wherein the bolt includes a wedge-shaped or tapering end portion that is configured to be fittingly received by a complementarily shaped recess of the keeper,

18. The ironing board assembly according to claim 15, wherein the bolt is slidably connected to a non-ironing side of the wing, and wherein the keeper is disposed on a non-ironing side of the main board, said keeper having a recess or opening for receiving an end of the bolt.

* * * * *